US006053600A

United States Patent [19]

Hotomi

[11] Patent Number: 6,053,600

[45] Date of Patent: Apr. 25, 2000

[54] INK JET PRINT HEAD HAVING HOMOGENEOUS BASE PLATE AND A METHOD OF MANUFACTURE

[75] Inventor: Hideo Hotomi, Nishinomiya, Japan

[73] Assignee: Minolta Co., Ltd., Osaka, Japan

[21] Appl. No.: 09/012,471

[22] Filed: Jan. 22, 1998

[30] Foreign Application Priority Data

Jan. 22, 1997 [JP] Japan ..... 9-009301
Mar. 18, 1997 [JP] Japan ..... 9-064248

[51] Int. Cl.[7] ..... B41J 2/05

[52] U.S. Cl. ..... 347/68; 310/358

[58] Field of Search ..... 347/20, 40, 68, 347/69, 70, 71, 72; 310/358, 328, 367

[56] References Cited

U.S. PATENT DOCUMENTS

| | | | |
|---|---|---|---|
| 4,369,455 | 1/1983 | McConica et al. | 346/140 R |
| 4,503,444 | 3/1985 | Tacklind | 346/140 R |
| 4,752,788 | 6/1988 | Yasuhara et al. | 346/140 |
| 5,208,605 | 5/1993 | Drake | 346/1.1 |
| 5,412,410 | 5/1995 | Rezanka | 347/15 |
| 5,446,485 | 8/1995 | Usui et al. | 347/72 |
| 5,653,901 | 8/1997 | Yoshimura | 219/121.71 |
| 5,790,155 | 8/1998 | Usui et al. | 347/68 |
| 5,825,121 | 10/1998 | Shimada | 310/358 |

FOREIGN PATENT DOCUMENTS

| | | |
|---|---|---|
| 0437062 | 7/1991 | European Pat. Off. . |
| 2282992 | 4/1995 | United Kingdom . |

*Primary Examiner*—Arthur T. Grimley
*Assistant Examiner*—Hoang Ngo
*Attorney, Agent, or Firm*—Sidley & Austin

[57] ABSTRACT

An ink jet print head 10 of the invention comprises a base plate 12 which includes a nozzle hole 14 and an ink supply channel 20 in one surface thereof and an actuator 30 which is bonded on the one surface of the base plate 12 to cover the nozzle hole and ink supply channel. The actuator 30 is formed in one surface adjacent to the base plate with an ink chamber 32 which connects the ink supply channel 20 and the nozzle hole 14. The ink chamber 32 and nozzle hole 14 are filled with an ink material, and the ink material is ejected through the nozzle hole 14 when it is pressurized by the actuator 30. According to the ink jet print head 10 of the invention, the number of parts constituting the head can be reduced, and a shorter production process and a lower production cost can be achieved.

15 Claims, 11 Drawing Sheets

INK JET PRINT HEAD HAVING HOMOGENEOUS BASE PLATE AND A METHOD OF MANUFACTURE

RELATED APPLICATIONS

This application is based on Japanese Patent Applications Nos. 9-9301 and 9-64248, and the content of each of these applications is incorporated herein by reference.

FIELD OF THE INVENTION

The present invention relates to an ink jet print head for recording an image by ejecting ink droplets from nozzles in response to image information, and allowing the ink droplets to be deposited to such recording medium as plain paper.

BACKGROUND OF THE INVENTION

Conventionally, there has been known an ink jet print head which includes piezoelectric actuators or members and a housing corresponding to the piezoelectric actuator. The housing has a chamber for containing an ink material and a nozzle for ejecting ink droplets of the ink material. In operation, a voltage or pulse is applied to the piezoelectric member in response to information corresponding to an image to be reproduced. This provides the piezoelectric member with a deformation, which pressurizes the ink material in the ink chamber and thereby eject the ink droplet through the nozzle.

Another ink jet print head has been proposed in which a diaphragm made from film is disposed between the piezoelectric member and the ink chamber so that the piezoelectric member is kept away from the ink material.

In these ink jet print heads, the ink chambers are formed in a uniform array at a regular interval. This requires that the piezoelectric members be arranged so that each piezoelectric member confront to the corresponding ink chamber. For this purpose, typically, the piezoelectric members are formed by firstly bonding a sintered piezoelectric plate onto a base plate and secondly cutting the piezoelectric plate into parallel pieces by the use of a suitable cutter or saw.

This piezoelectric member, as it is made of two components and further the components are bonded with adhesive, renders the manufacturing process thereof more complicated and requires more time for producing the same and decreases a yield rate of the piezoelectric member, which results in the print head being more expensive. Also, cutting the sintered piezoelectric plate requires an extended time and tends to reduce the productivity of the piezoelectric member, which further increases the production cost of the same.

SUMMARY OF THE INVENTION

Among the several objects and features of the invention may be noted the provision of an improved ink jet print head.

An ink jet print head 10 of the invention comprises a base plate 12 which includes a nozzle hole 14 and an ink supply channel 20 in one surface thereof and an actuator 30 which is bonded on the one surface of the base plate 12 to cover the nozzle hole 14 and ink supply channel 20. The actuator 30 is formed in one surface adjacent to the base plate 12 with an ink chamber 32 which connects the nozzle hole 14 and the ink supply channel 20. The ink chamber 32 and nozzle hole 14 are filled with an ink material, and the ink material is ejected through the nozzle hole 14 when it is pressurized by the actuator 30.

According to an ink jet print head 10 of the invention, the ink chamber 32 is formed in one surface of the actuator 30, and the nozzle hole 14 for ejecting the ink material and the ink supply channel 20 for supplying the ink material to the ink chamber 32 are formed in a base plate 12. In such manner, a main part of the ink jet print head is constituted simply by the base plate 12 and the actuator 30, and the number of parts of the head can be reduced. As a result, assembly of the head is completed in fewer steps, and a lower production cost and a higher yield rate can be achieved.

In another ink jet print head 50 of the invention, the base plate 12 is further provided with a groove 52 which defines an ink supply chamber 42 connected with the ink supply channel 20.

According to the ink jet print head 50 of the invention, in addition to an effect similar to that obtained by the ink jet print head 10, because a groove 52 in communication with ink supply channel 20 is formed in a base plate 12, and the groove 52 is used as the ink supply chamber 42 for supplying the ink material to the ink chamber 32 in actuator 30 through the ink supply channel 20, it is not required to use a component configured specifically for forming the ink supply chamber 42, as a result, further reduction of cost can be achieved.

Still another embodiment of the present invention is ink jet print head 110 comprising a member 112 which includes a nozzle hole 124 for ejecting an ink material, an ink chamber 130 in fluid communication with the nozzle hole 124 for supplying the ink material to the nozzle hole 124, and an ink supply channel 128 for supplying the ink material to the ink chamber 130. The nozzle hole 124, ink chamber 130 and ink supply channel 128 form an ink passage 133. The ink jet print head 110 further comprises an actuator 114 which is activated to pressurize the ink material in the ink chamber 130 and eject the ink material from the nozzle hole 124. The member 112 is made of a plurality of layers which are integrated by heating, and each of the layers defines at least one portion of the ink passage 133.

In the ink jet print head 110 according to the invention, the layers which define portions of the ink passage 133 are integrated upon burning of the actuator 114. The actuator 114 is also bonded integrally to the member 112 when the actuator 114 and the member 112 are burned. Accordingly, since no application of an adhesive is required in any step during assembly of the head, and the layers and the actuator 114 can be bonded integrally to each other in a single heating operation, a process of assembly can be simplified. As a result, an efficiency of producing a head is increased, and a lower production cost can be achieved.

BRIEF DESCRIPTION OF THE DRAWINGS

The present invention will be described with reference to the accompanying drawings wherein like reference numerals refer to like parts in the several views, and wherein.

PREFERRED EMBODIMENTS OF THE INVENTION

Figure 1:
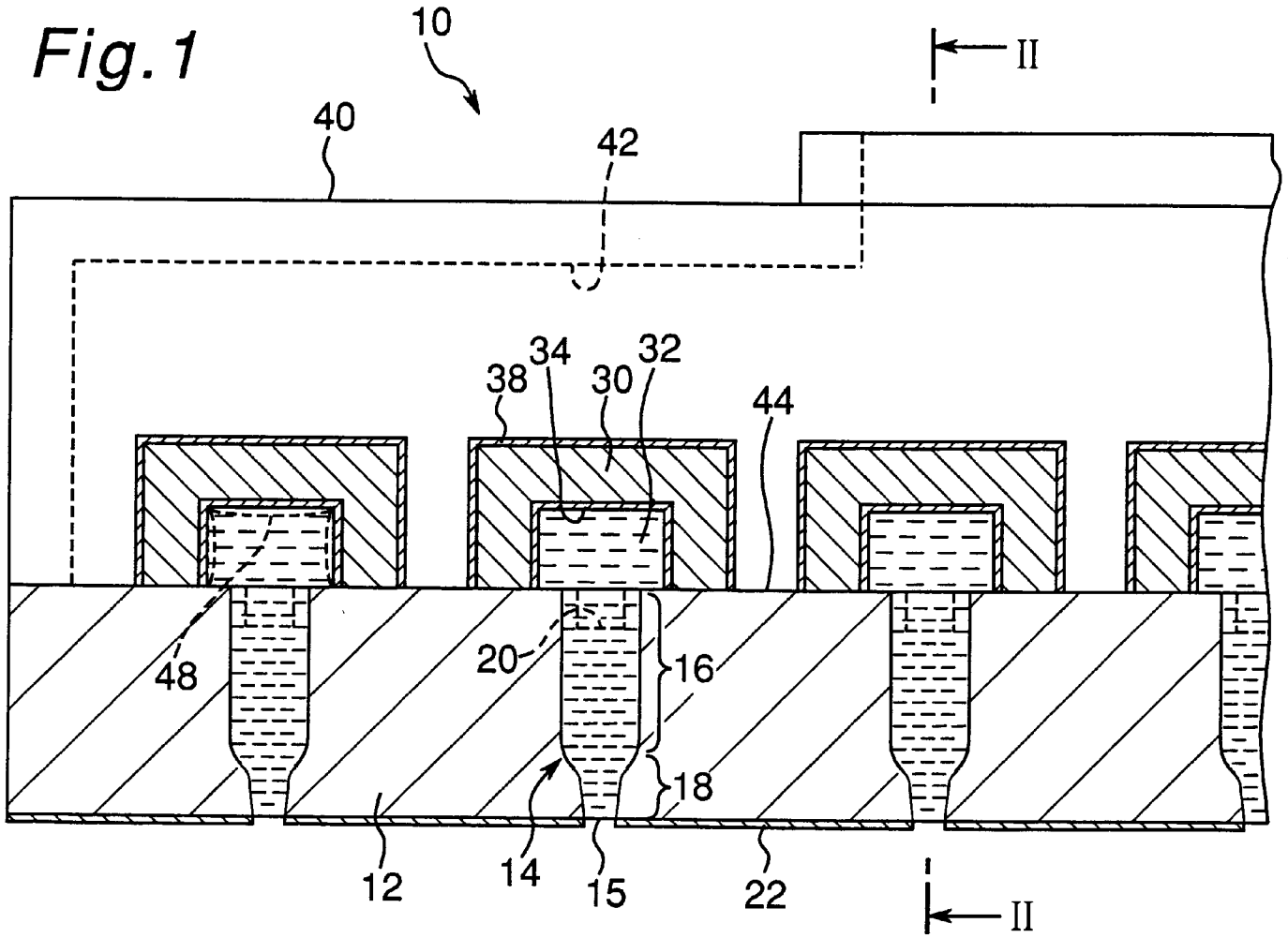
FIG. 1 is an enlarged transverse sectional view of an ink jet print head according to a first embodiment.
Figure 2:
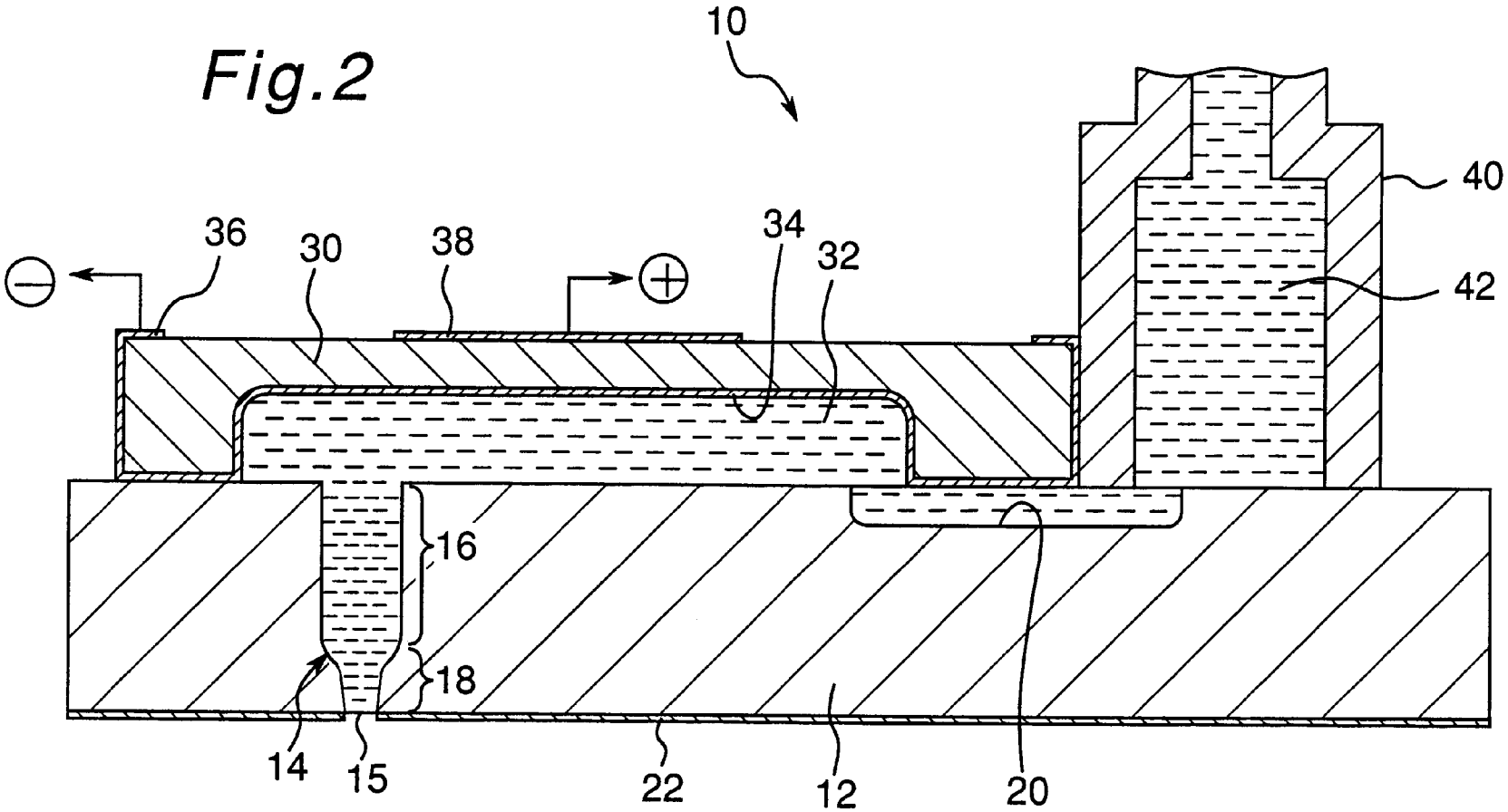
FIG. 2 is an enlarged longitudinal sectional view taken along a line II—II in FIG. 1.
Figure 3:
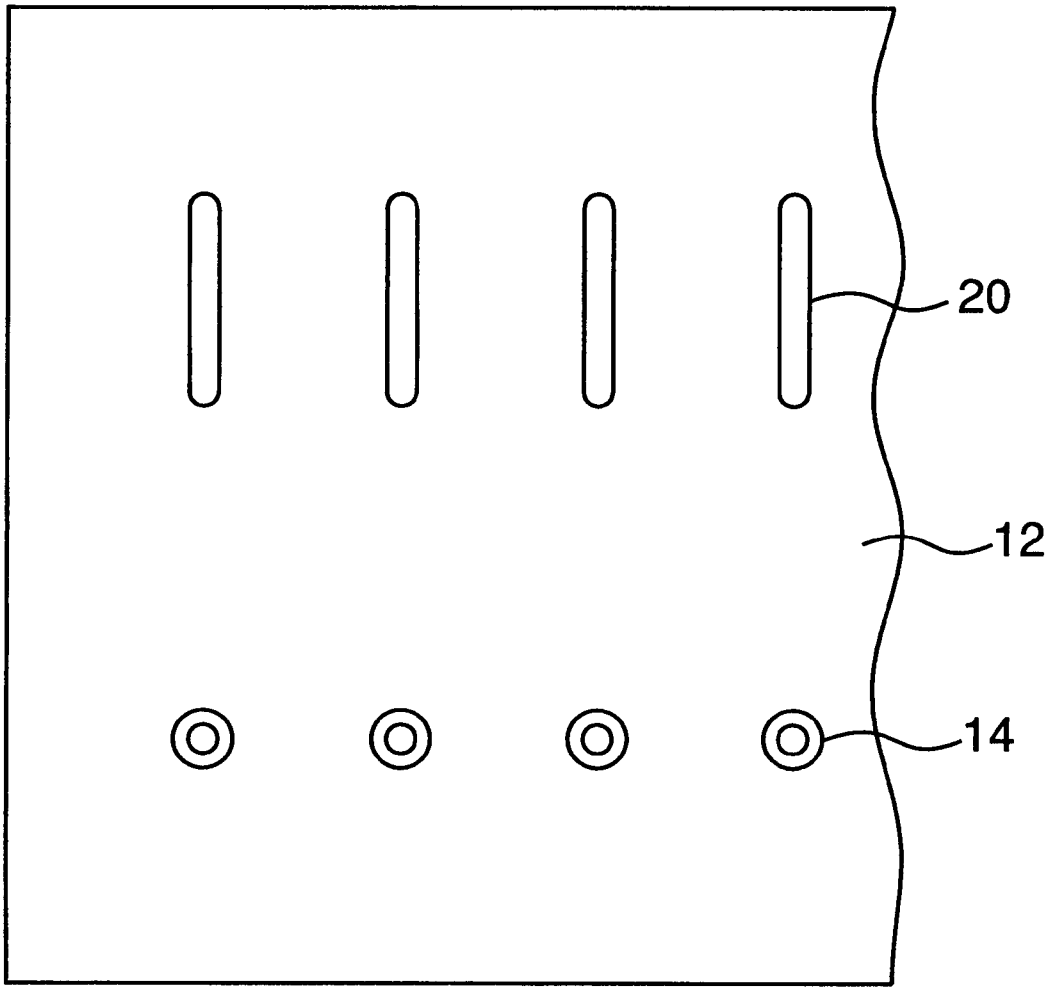
FIG. 3 is an enlarged partial top plan view of a base plate 12 of the head 10 shown in FIG. 1.

Referring to the drawings, embodiments of the invention will be described below. An ink jet print head 10 of a first embodiment is shown in FIGS. 1 and 2. The head 10 comprises a base plate 12 in the form of plate made of a ceramic, metal, glass, synthetic resin or the like. The base plate 12 is formed with a plurality of nozzle holes 14 at certain intervals, extending in the direction of thickness thereof. Each nozzle hole 14 is formed through two steps, as described later, and comprises a first portion 16 and a second portion 18, the second portion 18 being smaller in diameter than the first portion 16. In an upper surface of the base plate 12, a plurality of ink supply grooves or channels 20 are formed in correspondence with the nozzle holes 14. The ink supply channel 20 is spaced away from the nozzle hole 14 and is extended toward the nozzle hole 14, as illustrated in FIG. 3 which is a partial top plan view of the base plate 12 before it is assembled in the head 10.

On a lower surface of the base plate 12, an eutectoid plating 22 containing fluorine is deposited. Due to this, an ink repellent property is increased, which results in that an ink meniscus to be formed in the second portion 18 of nozzle hole 14 will be stabilized and thereby ink droplets having a required size can be ejected. An improved adhesion can be provided to the base plate 12 made of a ceramic or metal against the eutectoid plating 22.

To the upper surface of the base plate 12, a plurality of piezoelectric actuators 30 made from any known piezoelectric material is fixedly bonded. The piezoelectric actuator 30 is formed in a portion thereof facing the base plate 12 with an ink chamber 32 which is an elongated groove that is closed at both longitudinal ends thereof. The ink chamber 32 is in communication with a corresponding one of the nozzle holes 14 and an end of the ink supply channel 20 adjacent to the nozzle hole 14, respectively.

An inner wall of the ink chamber 32 is lined with a common electrode 34 made of a conductive metal layer. As shown in FIG. 2, the common electrode 34 is extended to respective upper surface portions of longitudinal opposite ends of the piezoelectric actuator 30. One extended portion 36 of the common electrode 34 located adjacent to the nozzle hole 14 is connected with a negative terminal (for example, a ground terminal) of a drive circuit through a flexible wiring (not shown). Also, the piezoelectric actuator 30 is provided on a central portion of the other surface or upper and side surfaces away from the ink chamber 32 with an individual electrode 38. The individual electrode 38 is extended longitudinally and connected with a positive terminal of the drive circuit through a flexible wiring (not shown).

An ink supply member 40, which is fluidly connected with an ink tank (not shown), is fixed on the base plate 12 in contact with longitudinal end surfaces of the piezoelectric actuators 30. The ink supply member 40 has herein an ink supply chamber 42. The ink supply chamber 42 is fluidly communicated with each ink chamber 32 of the piezoelectric actuator 30 through the ink supply channels 20.

The ink jet print head 10 so constructed will be produced as described below. First, the nozzle holes 14 and ink supply channels 20 are formed in the base plate 12 which is already provided at a lower surface thereof with the eutectoid plating 22. In this forming process, a conventional excimer laser beam machining is preferably available if the base plate 12 is made of a ceramic. The nozzle hole 14 is formed in two steps, a first step in which a first laser beam is illuminated to form a first portion 16 having a diameter approximately equal to that of the laser beam and a second step in which another laser beam having a diameter smaller than that of the first laser beam is illuminated to form the second portion 18 having a diameter approximately equal to that of the second laser beam. Instead of the laser beam machining, another technique may be employed for forming the first portion 16 of the nozzle hole 14 such as etching, cutting by abrasive grains using ultrasonic vibration of a cemented carbide mold and punching to a green sheet before sintering thereof.

Next, a piezoelectric plate is formed with a plurality of grooves for providing the ink chambers 32 in correspondence with the nozzles 14 and ink supply channels 20 by the excimer laser beam machining, then metal-plated to provide the common electrode 34 on an inner surface of each groove, and finally bonded to an upper surface of the base plate 12.

After the bonded piezoelectric plate is divided into a plurality of piezoelectric actuators 30 in such manner that a plurality of separated grooves 44 are formed in the piezoelectric plate by the laser machining or dicing, a conductive metal layer to be used for the individual electrode 38 is formed on an outer circumference thereof by plating or sputtering. Production and assembly of a main part of the ink jet print head 10 is now completed, and the ink supply member 40 is finally fixed to the base plate 12.

In the ink jet print head 10 so constructed, an ink material supplied from the ink tank to the ink supply chamber 42 is fed to the ink chambers 32 in the piezoelectric actuators 30 and the nozzle holes 14 through the ink supply channels 20. Then, when a voltage or pulse is applied between the individual electrode 38 and common electrode 34 by the drive circuit, a portion of the piezoelectric actuator 30 that is located in correspondence with the individual electrode 38 and forms three walls defining a portion of the ink chamber 32 is instantaneously deformed inwardly as shown by a dotted line 48 in FIG. 1. This pressurizes the ink material in the ink chamber 32, and thereby an ink droplet is ejected through a nozzle opening 15 in the base plate 12. The ink droplet is then deposited onto a recording medium, such as plain paper (not shown), and thereby an image is recorded on the recording medium.

As described above, according to the ink jet print head 10 of this embodiment, the main portion of the head is constituted simply by the base plate 12 and piezoelectric actuators 30. Therefore, the number of parts can be significantly reduced in comparison with the conventional head, and a cost for the parts can be reduced. Further, since assembly can be completed in fewer steps and the number of possible defects at assembling will be reduced, a higher yield rate can be achieved, and time required for assembling will be reduced, resulting in a lower production cost.

In the mean time, the piezoelectric plate may be used without being cut into a plurality of piezoelectric actuators. In such case, individual electrodes are provided on portions of an upper surface of the piezoelectric plate corresponding to the ink chambers and only these portions will be driven.

Figure 4:
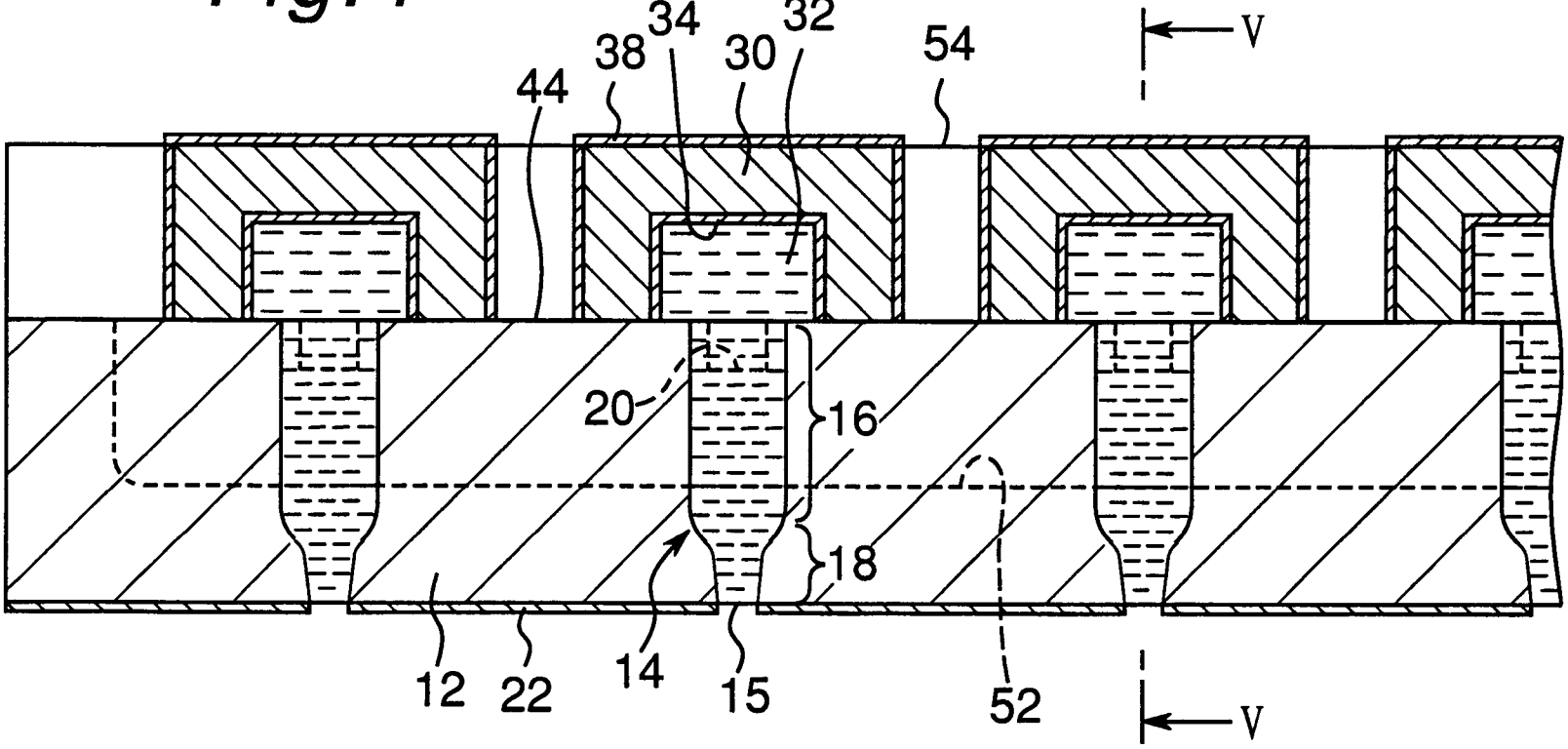
FIG. 4 is an enlarged transverse sectional view of an ink jet print head according to a second embodiment.
Figure 5:
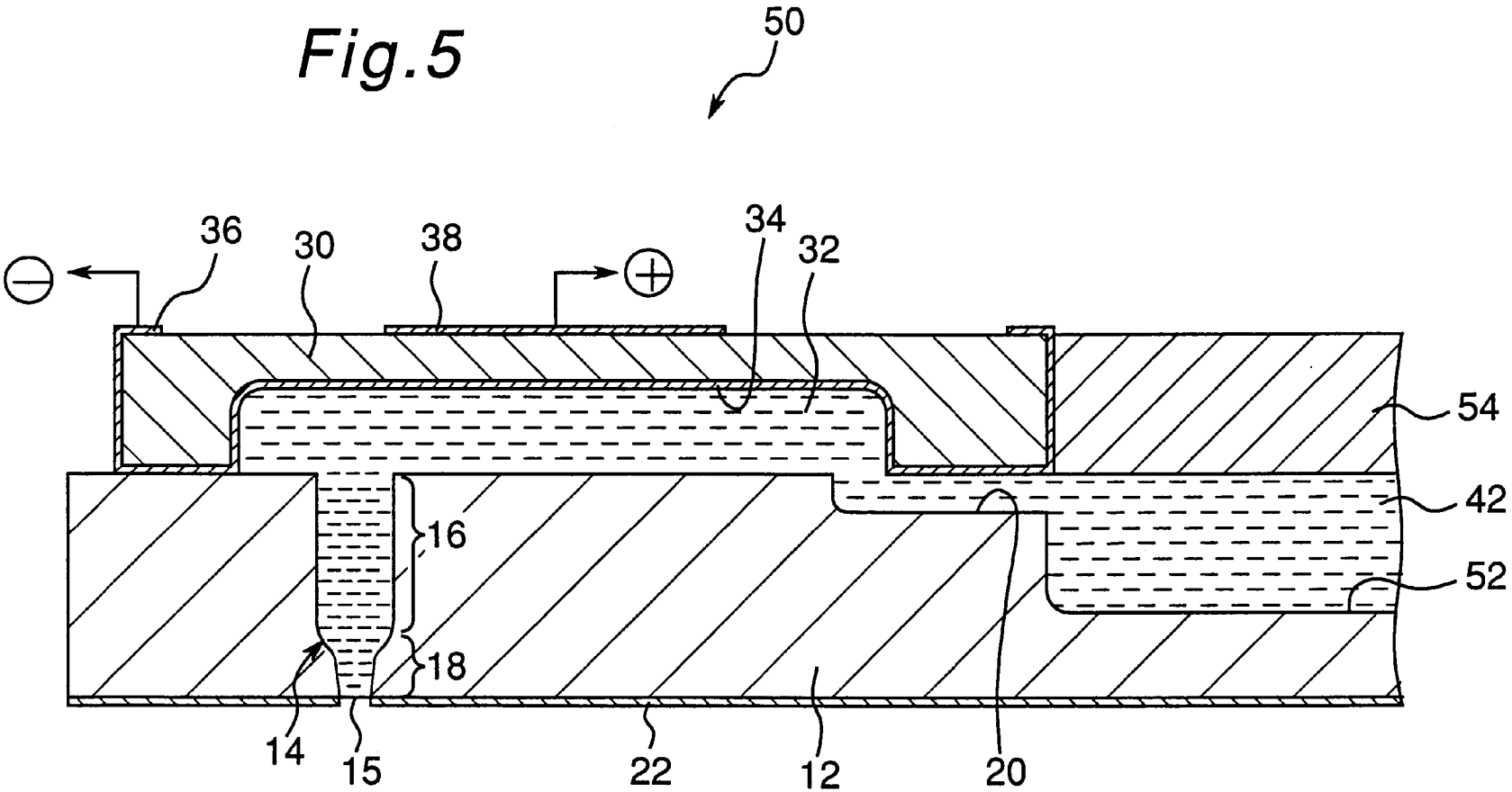
FIG. 5 is an enlarged longitudinal sectional view taken along a line V—V in FIG. 4.

With reference to FIGS. 4 and 5, another ink jet print head 50 of the second embodiment will be described. The ink jet print head 50 is similar in construction to that of the first embodiment with respect to the base plate 12 and piezoelectric actuators 30, and therefore only distinctive characteristics are described.

Figure 6:
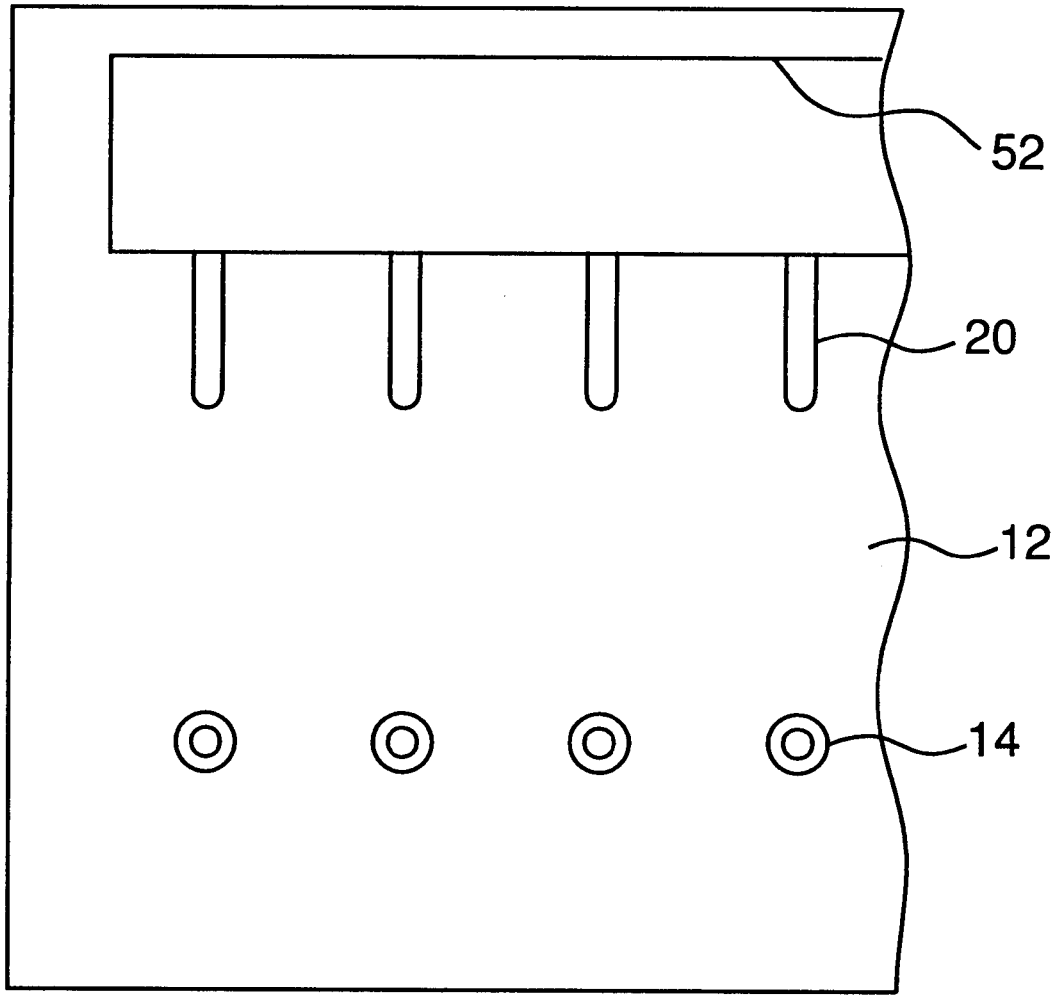
FIG. 6 is an enlarged partial top plan view of a base plate 12 of the head 50 shown in FIG. 4.

In a base plate 12 of the ink jet print head 50, a groove 52 is formed in communication with ends of the ink supply channels 20 which ends are remote from nozzle holes 14, as illustrated in FIG. 6 which is a partial top plan view of the base plate 12 before it is assembled in the head 50. The groove 52 is covered by a cover plate 54 to define an ink supply chamber 42 surrounded thereby. The ink material is supplied from the ink supply chamber 42 to the ink chambers 32 through the ink supply channels 20.

Thus, with the ink jet print head 50, since the ink supply chamber 42 is also provided in the base plate 12, it is not required to use such component of a specific shape as the ink supply member 40 in the first embodiment that is provided therein with a hollow area, and a cost for parts can be further reduced.

Although the nozzle holes 14 are formed to be reduced in size between the first portion 16 and the second portion 18 in the first and second embodiments, they are not limited to such shape, and may be formed, for example, in such manner that the inner diameter is progressively reduced from the ink chambers 32 to the nozzle openings 15 in the lower surface of the base plate 12. The ink supply channels 20 may be also formed, for example, in such manner that they are reduced in width toward the ink supply chamber 42 instead of having a constant width. In this case, a back pressure caused toward the ink supply chamber 42 upon driving of the actuator can be reduced, and a driving force of the actuator can be more efficiently utilized.

Figure 7:
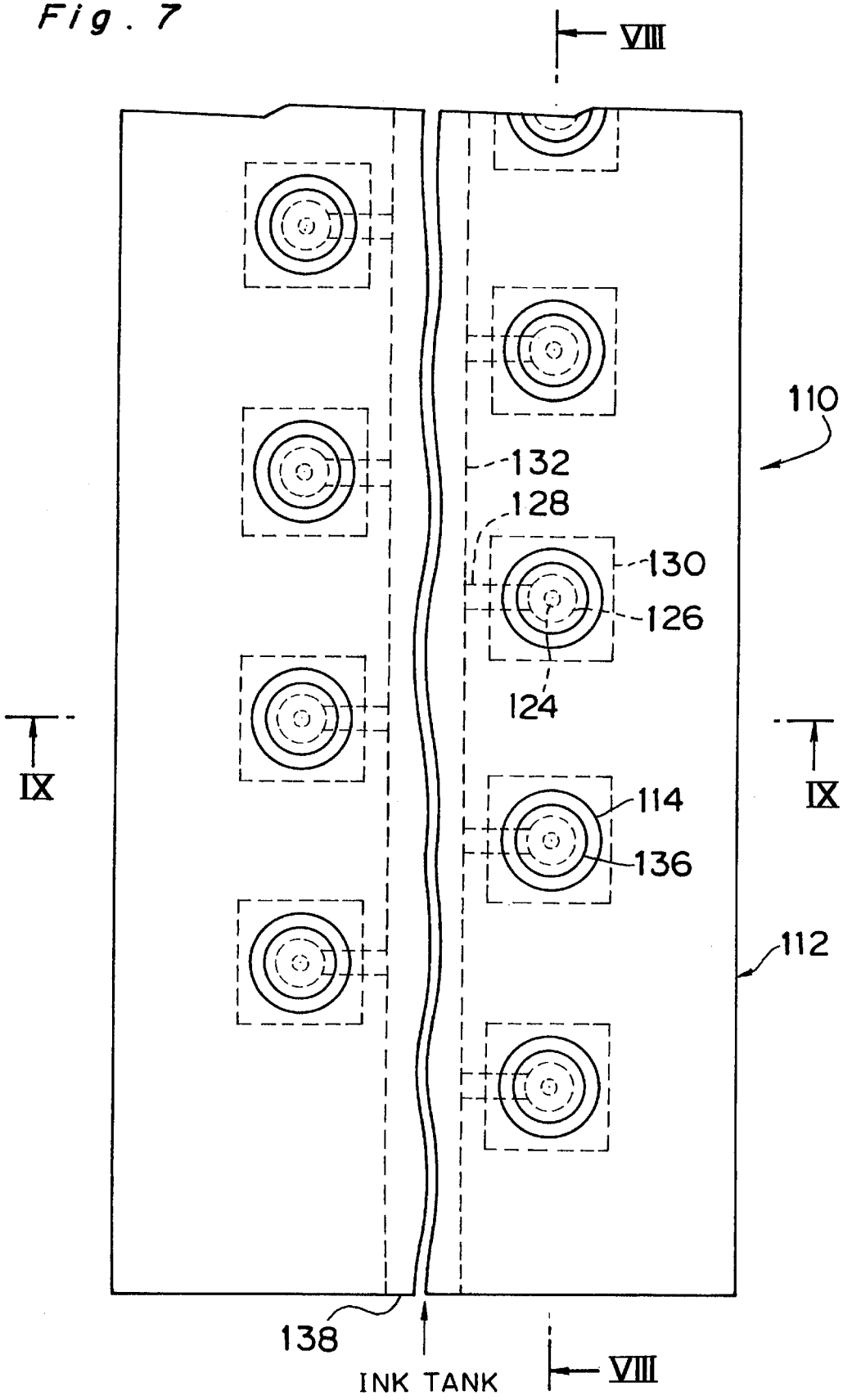
FIG. 7 is an enlarged partial top plan view of an ink jet print head according to a third embodiment.
Figure 8:
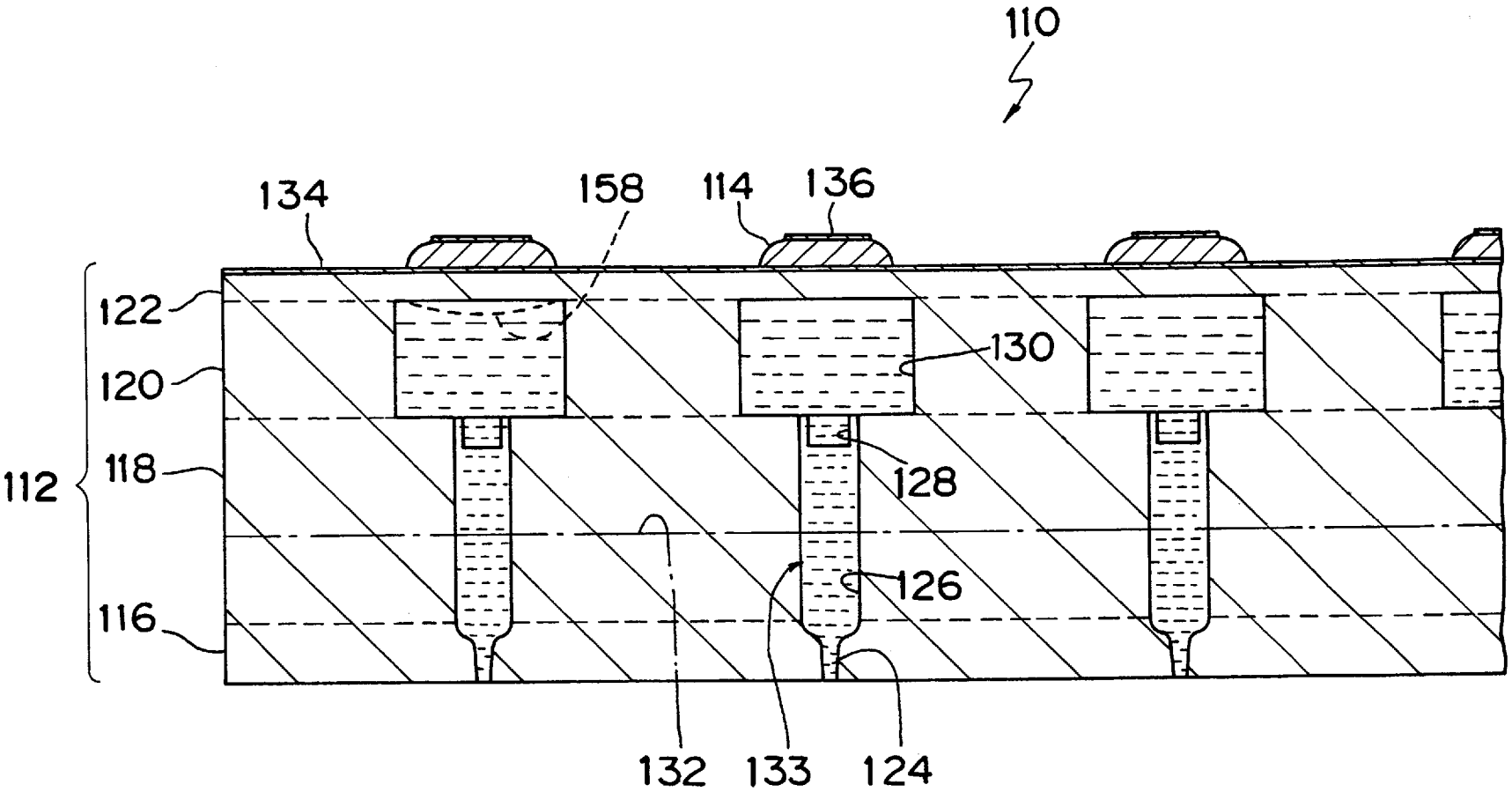
FIG. 8 is an enlarged sectional view taken along a line VIII—VIII in FIG. 7.
Figure 9:
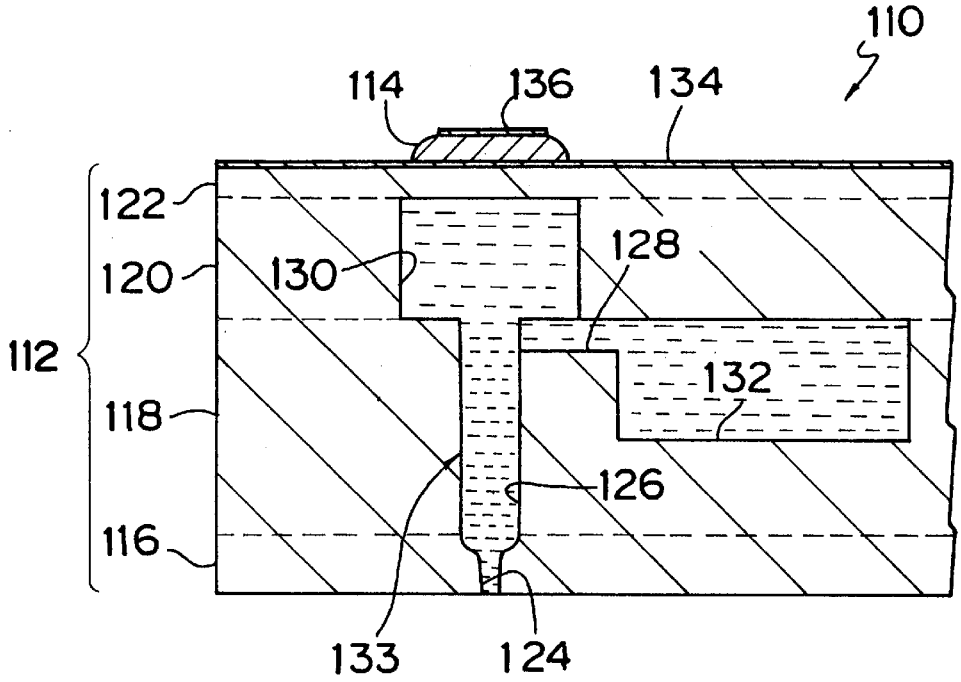
FIG. 9 is an enlarged sectional view taken along a line IX—IX in FIG. 7.

Next, an ink jet print head 110 according to a third embodiment will be described by referring to FIGS. 7 to 9. The head 110 comprises a channel unit 112 and piezoelectric actuators 114. The channel unit 112 is formed by laminating four ceramic layers 116, 118, 120 and 122 that are delimited by dotted lines in sectional views shown in FIGS. 8 and 9, and the layers are bonded integrally to each other by sintering. The channel unit 112 is further provided with ink channels 133 comprising nozzles 124, communicating holes 126, ink supply channels 128, ink chambers 130 and an ink supply chamber 132.

The ceramic layers 116, 118, 120 and 122 include portions that partly form the ink channels 133, respectively. In other words, in the first ceramic layer 116, a plurality of the nozzles 124 each in the form of a funnel are formed, and positioned in a staggered arrangement at regular intervals in both sides with respect to the ink supply chamber 132, as shown in FIG. 7. A water repellent finish is preferably applied to a lower surface of the first ceramic layer 116 for stabilization of an ink meniscus in the nozzle 124.

In the second ceramic layer 118, the communicating holes 126 are formed concentrically in such manner that they are in communication with the nozzles 124, respectively. Further in the second ceramic layer 118, the ink supply chamber 132, extending in a longitudinal direction in a central part of the head 110, and the ink supply channels 128, connecting the ink supply chamber 132 and the communicating holes 126, respectively, are formed.

The ink supply chamber 132 is closed at an end (not shown), and connected with an ink tank (not shown) at an open end in the other side.

In the third ceramic layer 120, the ink chambers 130 are formed, and connected with the communicating holes 126 and ink supply channels 128, respectively. The fourth ceramic layer 122 covers the ink chambers 130 so that it provides a wall thereof, and serves as a diaphragm. Additionally, a common electrode 134 made of a conductive metal layer is formed on an upper surface of the fourth ceramic layer 122.

The piezoelectric actuators 114 each formed generally in the form of a disk are provided in correspondence with the ink chambers 130, respectively, on the common electrode 134 on a surface of the channel unit 112. Individual electrodes 136 made of a conductive metal layer are provided on the top of the piezoelectric actuators 114, respectively.

Now, a process of producing the ink jet print head 110 so constructed will be described. The ceramic layers 116, 118, 120 and 122 are made of any known ceramic materials (for example, zirconium oxide, aluminum oxide), and individually processed when they are still green sheets before sintering.

Figure 10:
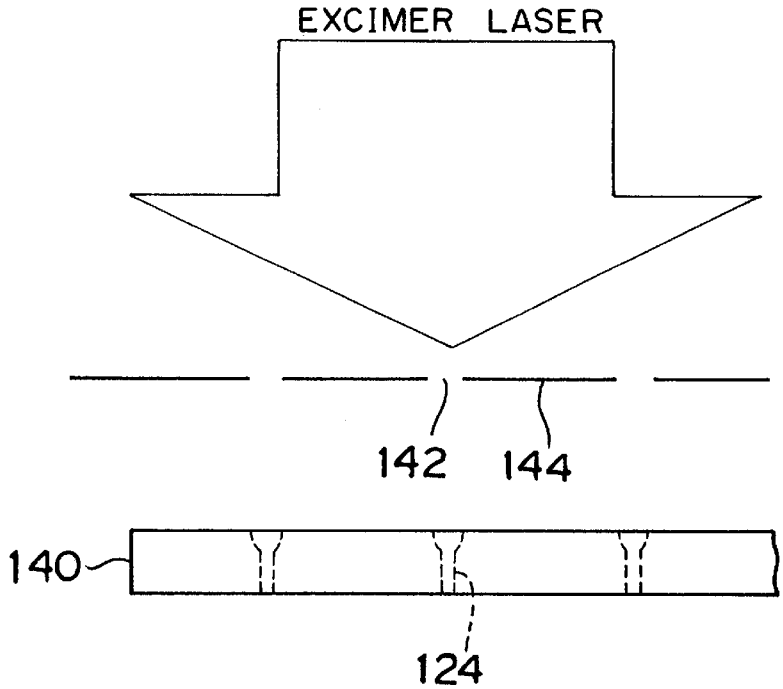
FIG. 10 is an enlarged side elevational view which shows a method for forming nozzle holes in a first ceramic layer of a channel unit.

As shown in FIG. 10, an excimer laser beam illuminates a green sheet 140 to be the first ceramic layer 116 through a mask 144 with a plurality of openings 142 formed therein, and the nozzles 124 are formed by abrasion.

Figure 11:
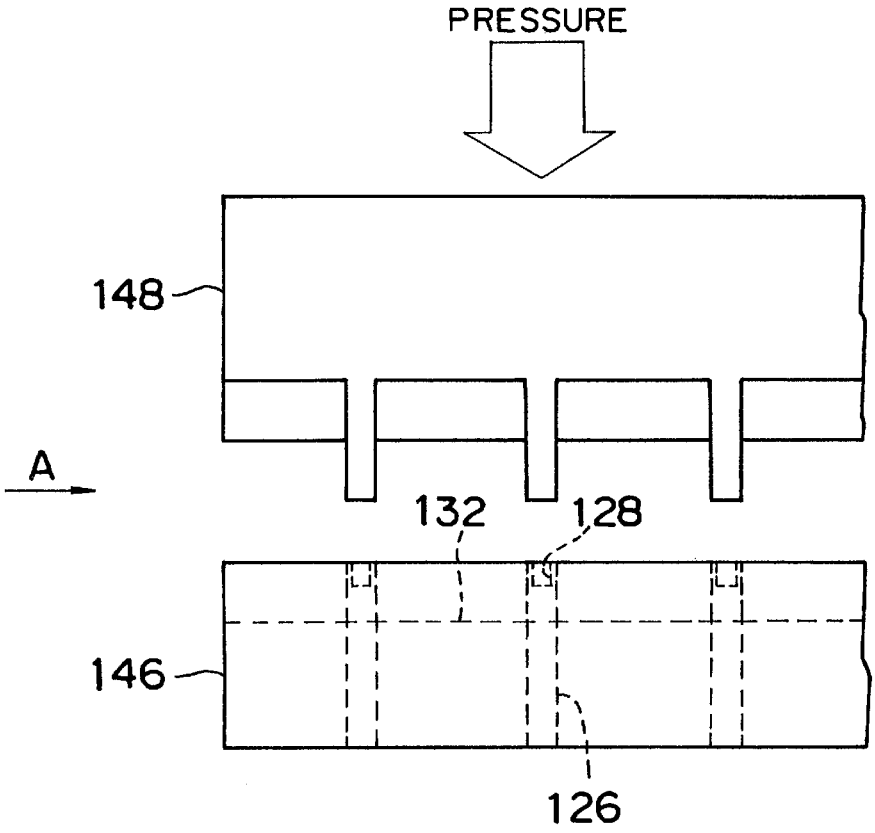
FIG. 11 shows a method for forming nozzle holes in a second ceramic layer of a channel unit.
Figure 12:
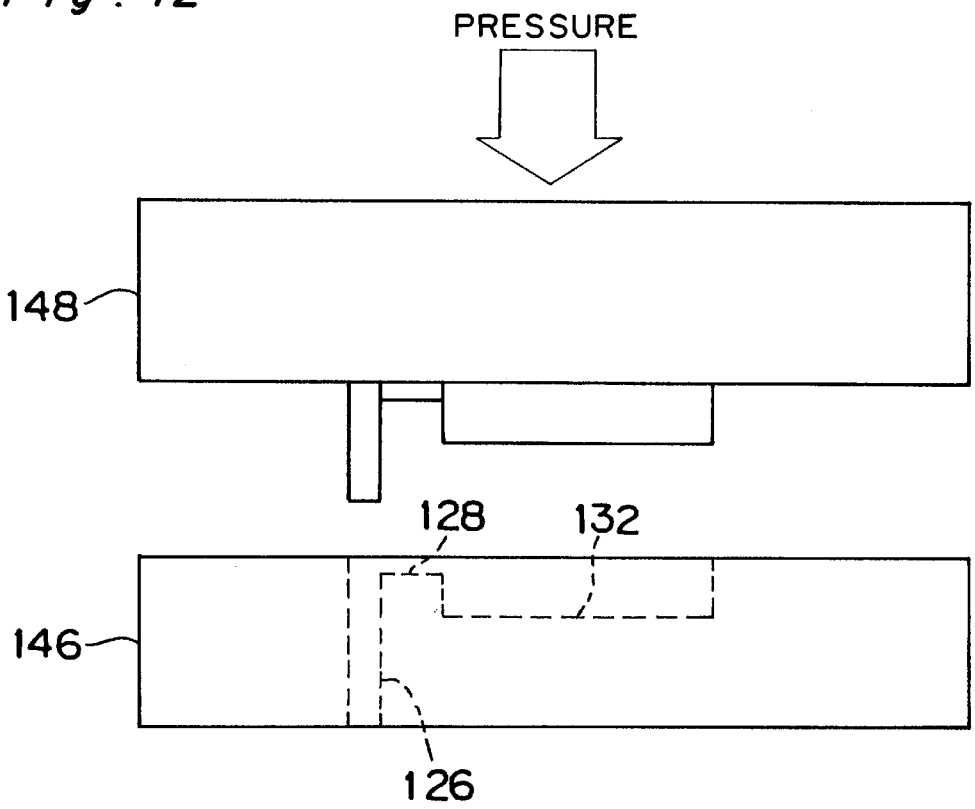
FIG. 12 is a side elevational view taken in the direction of an arrow A in FIG. 11.

As shown in FIGS. 11 and 12, a green sheet 146, to be the second ceramic layer 118, is punched by using a cemented carbide mold 148 to produce through-holes and grooves that are to be the communicating holes 126, ink supply channels 128 and ink supply chamber 132, respectively. The communicating holes 126 and ink supply channels 128 may be formed in both sides with respect to the ink supply chamber 132 by rotating the cemented carbide mold 148 or green sheet 146 for two steps of punching operation, or the cemented carbide mold 148 may be formed in such shape that the communicating holes 126 and ink supply channels 128 can be formed in both sides with respect to the ink supply chamber 132 by one step of punching operation.

Figure 13:
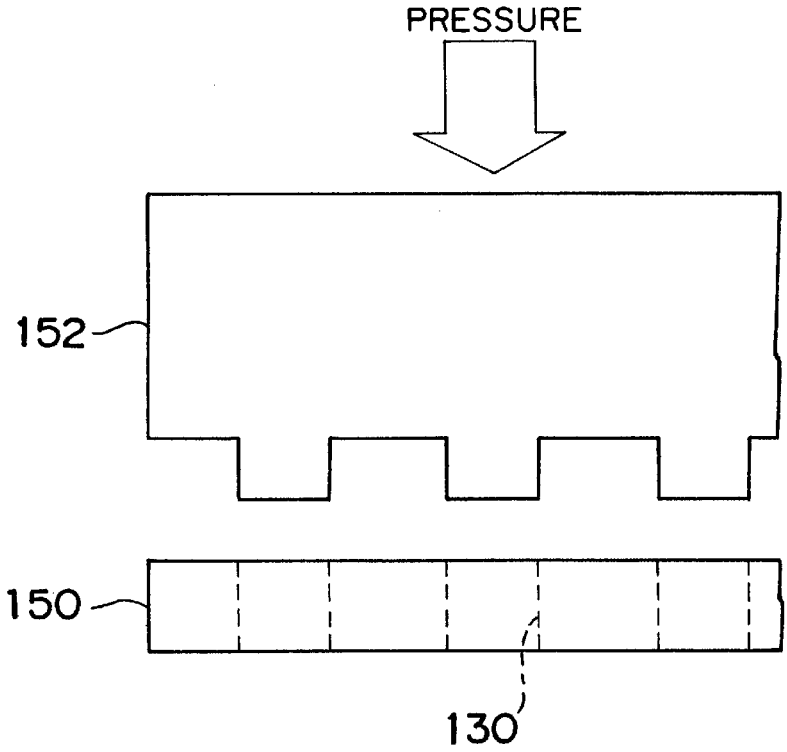
FIG. 13 shows a method for forming holes for ink chambers in a third ceramic layer of a channel unit.

As shown in FIG. 13, similarly in a green sheet 150 that comes to be the third ceramic layer 120, rectangular through-holes are formed to provide the ink chambers 130 by punching.

Figure 14:
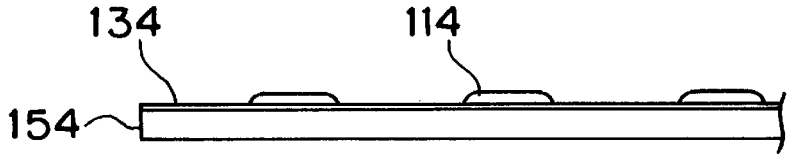
FIG. 14 shows a method for forming a fourth ceramic layer in a channel unit and piezoelectric actuators.

As shown in FIG. 14, to an upper surface of a green sheet 154 that comes to be the fourth ceramic layer 122, an electrode material, for example, an Ag-Pd paste is applied in a uniform thickness by screen printing or the like for providing the common electrode 134, and then a paste of any known piezoelectric material (for example, PZT) is applied on the electrode material by screen printing or the like to form the piezoelectric actuators 114.

The green sheets 140, 146, 150 and 154 formed as described above are accurately aligned with each other by using a jig, respectively, as they are laminated in that order, and brought into close contact with each other by application of a pressure after they are laminated. Then, the laminated sheets are sintered in a heating furnace. The sintering operation is conducted in such conditions that the laminated sheets are heated to about 1200° C. in 2 hours, for example, maintained at that temperature for 1.5 hours, and cooled spontaneously in the furnace. In such manner, the ceramic layers 116, 118, 120 and 122 and piezoelectric actuators 114 are sintered, and bonded integrally to each other.

After the sintered product is removed from the heating furnace, the individual electrodes 136 are formed on top of the piezoelectric actuators 114 by screen printing of an Ag-Pd paste, Au-sputtering or the like. Then, a high voltage is applied between the common electrode 134 and individual electrodes 136 under a high temperature for polarization of the piezoelectric actuators 114.

Thus, according to the ink jet print head 110 of this embodiment, a plurality of ceramic layers 116, 118, 120 and 122 constituting the channel unit 112 and the piezoelectric actuators 114 are integrally bonded to each other upon sintering without using any adhesive. As a result, since application of adhesive is not required in any step during assembly of the ink jet print head 110, and the members can be simultaneously sintered and thereby bonded in single heating operation, a process of assembly and production of the head can be simplified, and a higher productivity and a lower production cost can be achieved.

In the ink jet print head 110, an ink material supplied from an ink tank (not shown) to the ink supply chamber 132 is fed through the ink supply channel 128, and contained in the ink chamber 130, communicating hole 126 and nozzle 124. In such state, when a voltage or pulse is applied between the individual electrode 136 and common electrode 134 by a driving circuit in response to an image signal, the piezoelectric actuator 114 is instantaneously deformed such that it is contracted in the radial direction. As a result of the deformation, as shown by a dotted line 158 in FIG. 8, the fourth ceramic layer 122 is displaced arcuately, projecting in a convex manner toward the ink chamber 130. The ink material pressurized by the displacement is ejected as an ink droplet through the nozzle 124, and deposited to a recording medium (not shown), thus an image is recorded. As soon as application of the voltage is turned off, the piezoelectric actuator 114 and the wall of the ink chamber 130 return to their original state or undeformed state, and the ink material is supplied from the ink supply chamber 132 to the ink chamber 130.

The lamination of ceramic layers in the channel unit 112 of the ink jet print head 110 described above is not limited to a of four layer configuration, and can be modified in various manners.

Although the piezoelectric actuators are subjected to polarization using the individual electrodes provided after sintering in the third embodiment, if an electrode material for the individual electrodes is applied to the piezoelectric actuators by screen printing or the like before sintering, the individual electrodes can also be bonded at the same time, and a production process of the head can be further simplified. In such case, polarization of the piezoelectric actuators can be performed by applying a high voltage between the common electrode 134 and individual electrodes 136 after a predetermined time elapses and the piezoelectric material is crystallized. In such manner, processes including polarization of piezoelectric actuators can be completed in a single process, and a production process of the head can be further simplified.

Figure 15:
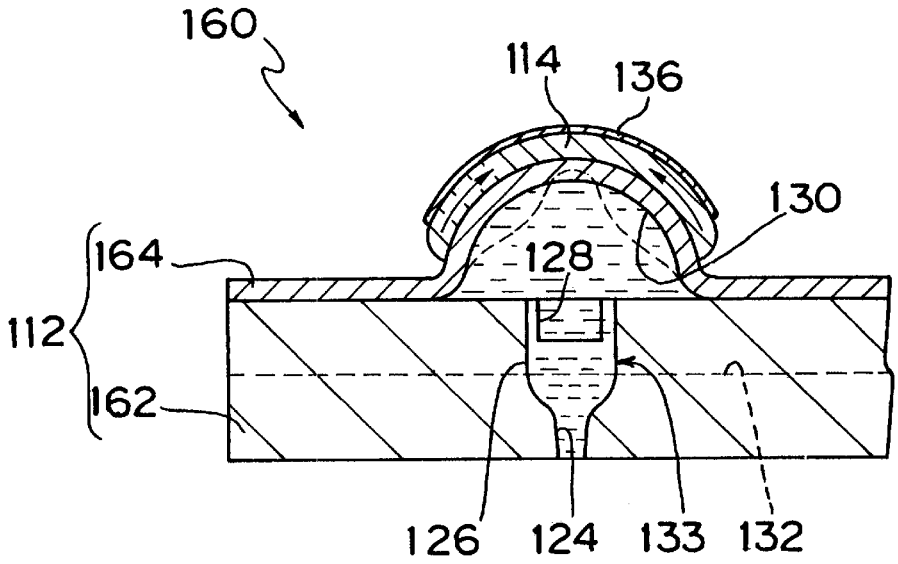
FIG. 15 is an enlarged partial sectional view of an ink jet print head according to a fourth embodiment.

By referring to FIG. 15, an ink jet print head 160 according to a fourth embodiment will be described. FIG. 15 is an enlarged partial sectional view of the head 160 taken in the same direction as that of the ink jet print head 110 in FIG. 8, and a top plan view of the head 160 is generally similar to that of FIG. 7.

As shown in FIG. 15, a channel unit 112 of the ink jet print head 160 consists of a base plate 162 and an ink-chamber-forming member 164 layered on an upper part of the base plate 162, which are made of metallic materials, respectively. The base plate 162 is formed, for example, by Ni-electroforming, and provided with nozzles 124, communicating holes 126, an ink supply chamber 132 and ink supply channels 128 connecting the communicating holes 126 with the ink supply chamber 132. In the ink-chamber-forming member 164, hemispherical ink chambers 130 are formed in communication with the communicating holes 126 and ink supply channels 128 by embossing, for example, a nickel sheet. Above the ink chamber 130, a piezoelectric actuator 114 having an individual electrode 136 thereon is provided. In the embodiment, the ink-chamber-forming member 164 can be used as a common electrode because of its conductivity.

The base plate 162 and the ink-chamber-forming member 164 are integrally bonded to each other by diffusion bonding in respective contact surfaces as they are heated during sintering of the piezoelectric actuators 114. Accordingly, in this embodiment as well, similarly to the case of the ink jet print head 110, since the base plate 162, ink-chamber-forming member 164 and piezoelectric actuators 114 can be bonded in a single heating operation without using any adhesive, a process of assembly of the head can be simplified, and a higher productivity and a lower production cost can be achieved.

In the ink jet print head 160, when a voltage is applied between the individual electrode 136 and ink-chamber-forming member 164 by a drive circuit, the piezoelectric actuator 114 is deformed such that it is contracted in the direction of arrows 166. As a result of the deformation, an inner surface of the ink chamber 130 is displaced to a position shown by a dotted line 168, and thereby the ink material in the ink chamber 130 is pressurized so that an ink droplet is ejected out of the nozzle 124.

The ink-chamber-forming member 164 is not limited to the shape shown in FIG. 15, and can be modified in various manners. For example, the ink-chamber-forming member 164 may be shaped as if the third and fourth ceramic layers 120 and 122 in the ink jet print head 110 are integrally formed into ink-chamber-forming member 164.

Although the present invention has been fully described by way of examples with reference to the accompany drawings, it is to be noted that various changes and modifications will be apparent to those skill in the art. Therefore, unless otherwise such changes and modifications depart from the scope of the present invention, they should be construed as being included thereto.

What is claimed is:

1. An ink jet print head, comprising:

a homogeneous base plate, said base plate having a nozzle hole and an ink supply channel integrally formed in one surface thereof; and an actuator fixed to said one surface of said base plate to cover said nozzle hole and said ink supply channel;

wherein said actuator, having an ink chamber integrally formed in a first surface, is fixed to said base plate, and said ink chamber connects said ink supply channel and said nozzle hole, and wherein said ink supply channel, said ink chamber, and said nozzle hole can be filled with an ink material, and said ink material can be pressurized by said actuator and ejected through said nozzle hole.

2. An ink jet print head according to claim 1, wherein said actuator is made of a piezoelectric material capable of being deformed when a voltage is applied thereto.

3. An ink jet print head according to claim 2, further comprising a first electrode attached to at least a portion of a surface of said ink chamber, and a second electrode attached to a second surface of said actuator.

4. An ink jet print head according to claim 1, wherein said actuator is bonded to said base plate.

5. An ink jet print head according to claim 1, wherein said base plate is further provided with a groove which defines an ink supply chamber connected with said ink supply channel.

6. An ink jet print head according to claim 1, wherein said ink chamber contains said ink material.

7. An ink jet print head, comprising:

a homogeneous base plate, said base plate having a plurality of nozzle holes and a plurality of ink supply channels integrally formed in one surface thereof, wherein one nozzle hole of said plurality of nozzle holes corresponds to one of said plurality of ink supply channels for said plurality of nozzle holes; and a plurality of actuators fixed to said one surface of said base plate, wherein one actuator of said plurality of actuators covers a corresponding one of said plurality of nozzle holes and a corresponding one of said plurality of ink supply channels for said plurality of actuators;

wherein each of said plurality of actuators, having an ink chamber integrally formed in a first surface thereof, is fixed to said base plate, and each ink chamber respectively connects a corresponding one of said plurality of ink supply channels to a corresponding one of said plurality of nozzle holes, and wherein each of said plurality of ink supply channels, each of said plurality of ink chambers and each of said plurality of nozzle holes can be filled with an ink material.

8. An ink jet print head according to claim 7, wherein each of said plurality of actuators is made of a piezoelectric material capable of being deformed when a voltage is applied thereto.

9. An ink jet print head according to claim 8, further comprising a common electrode and a plurality of individual electrodes, wherein said common electrode is attached to said first surfaces of said plurality of actuators and each of said plurality of individual electrodes is attached to a second surface of each of said plurality of actuators opposite said first surface.

10. An ink jet print head according to claim 7, wherein said actuator is bonded to said base plate.

11. An ink jet print head according to claim 7, wherein said base plate is further provided with a groove which defines an ink supply chamber connected with at least a portion of said plurality of ink supply channels.

12. An ink jet print head according to claim 7, wherein each of said plurality of ink chambers contains said ink material.

13. A method for assembling an ink jet print head, comprising the steps of:

(a) providing a homogeneous base plate, said base plate having a first surface and a second surface;

(b) forming a nozzle hole in said base plate which extends between said first and second surfaces;

(c) forming an ink supply channel in said first surface of said base plate;

(d) providing a piezoelectric member having one surface;

(e) forming a recess in said one surface of said piezoelectric member; and (f) assembling said base plate and said piezoelectric member so that said first surface of said base plate faces to said one surface of said piezoelectric member and thereby said recess fluidly connects said nozzle hole and said ink supply channel to form an ink chamber for containing an ink material.

14. A method according to claim 13, wherein said base plate is made of a ceramic material, and said nozzle hole is formed by an excimer laser beam.

15. A method according to claim 13, further comprising a step of plating a surface of said recess to form an electrode thereon prior to said step of assembling.

* * * * *